US006120268A

United States Patent [19]

Bush et al.

[11] Patent Number: 6,120,268

[45] Date of Patent: Sep. 19, 2000

[54] SCROLL COMPRESSOR WITH REVERSE OFFSET AT WRAP TIPS

[75] Inventors: James W. Bush, Skaneateles; Alexander Lifson, Manlius, both of N.Y.

[73] Assignee: Carrier Corporation, Farmington, Conn.

[21] Appl. No.: 08/931,702

[22] Filed: Sep. 16, 1997

[51] Int. Cl.[7] ..... F04C 18/04

[52] U.S. Cl. ..... 418/55.2

[58] Field of Search ..... 418/55.2

[56] References Cited

U.S. PATENT DOCUMENTS

| | | | |
|---|---|---|---|
| 3,874,827 | 4/1975 | Young | 418/55.5 |
| 4,216,661 | 8/1980 | Tojo et al. | 62/505 |
| 4,639,201 | 1/1987 | Caillat | 418/55.2 |
| 4,666,380 | 5/1987 | Hirano et al. | 418/55.2 |
| 4,673,340 | 6/1987 | Mabe et al. | 418/15 |
| 5,056,336 | 10/1991 | Harrison | 62/498 |
| 5,342,184 | 8/1994 | Comparin et al. | 418/55.2 |
| 5,370,512 | 12/1994 | Fujitani et al. | 418/55.2 |
| 5,421,707 | 6/1995 | Daniels | 418/55.2 |

FOREIGN PATENT DOCUMENTS

| | | |
|---|---|---|
| 4341148 A1 | 6/1994 | Germany . |
| 19603110 A1 | 5/1997 | Germany . |
| 62-87601 | 4/1987 | Japan . |

OTHER PUBLICATIONS

Derivation of a General Relation Governing the Conjugacy of Scroll Profiles; James W. Bush and Wayne P. Beagle; Purdue 1992.

Maximizing Scroll Compressor Displacement using Generalized Wrap Geometry; James W. Bush, Wayne P. Beagle, Mark E. Housman; Purdue 1994.

Performance and Application of High Pressure Ratio Scroll Compressors; Alexander Lifson, James W. Bush, H. Ezzat Khalifa; AES vol. 34, heat Pump and Refrigeration Systems Design, Analysis and Applications.

General Stability and Design Specification of the Back–Pressure Supported Axially Compliant Orbiting Scroll; James W. Bush, David K. Haller, Christopher R. Galante; Purdue 1992.

*Primary Examiner*—John J. Vrablik

*Attorney, Agent, or Firm*—Carlson, Gaskey & Olds

[57] ABSTRACT

An improved geometry for scroll wrap inner portion includes a groove which facilitates opening of the compression chambers to the discharge ports early in the cycle of the orbiting scroll. Stated one way, a forward end of the scroll wrap tip is thinner than a portion spaced from the forward end. A first curve defines the forwardmost end of said tip and extends to a forward ledge. A second circular curve is spaced from the forward ledge and extends to a rear ledge. An intermediate curve connects the forward and rear ledges. The rear curve is centered on a second radius, and if the second radius were extended beyond the rear ledge, the extension would move to a position spaced from the forward ledge and towards the opposed wrap. The swing radius for the scroll compressor wrap measured begins at the position wherein the forward ledge of one wrap faces the rear ledge of an opposed wrap begins on one side of zero, then crosses zero with an increasing scroll wrap, and then moves to an opposed side of zero. The inventive scroll compressor wrap achieves more rapid and smooth opening of the compression chambers to the discharge ports.

16 Claims, 3 Drawing Sheets

SCROLL COMPRESSOR WITH REVERSE OFFSET AT WRAP TIPS

BACKGROUND OF THE INVENTION

This invention relates to an improved configuration of the inner tips of scroll wraps that facilitate opening of the discharge port to the compression chambers.

Scroll compressors are becoming widely utilized for many refrigerant compression applications. A scroll compressor consists of a fixed and an orbiting scroll each having interfitting wraps. The orbiting scroll moves relative to the fixed scroll to move compression chambers to a discharge port.

Much effort has gone into the design of the scroll wrap. Originally scroll wrap were configured as relatively thin wraps of a single thickness. More recently, thicker scroll wraps having a shape generally defined by alternate arcs of a circle have been developed. As shown in FIG. 1A, this type scroll compressor 10 includes an orbiting scroll wrap 11 and a fixed scroll wrap 12. The orbiting scroll wrap 11 is shown at a point immediately after completion of discharge. Orbiting scroll wrap 11 closes off the majority of the discharge port 13. As shown, the wraps 11 and 12 have an outer surface 14 that is essentially centered on a first radius R1 and a second surface 15 immediately following surface 14 which is centered on a second radius R2. Although only the fixed scroll wrap 12 is shown with the radii defined, the same configuration is preferably utilized to form the scroll wrap for the orbiting scroll 11.

In this prior art compressor, compression chambers 16 and 17 which are about to begin opening to the discharge port 13 are shown on each side of the connection between the inner tip of the wraps 11 and 12. The orbiting scroll 11 will move essentially in a direction X as the next increment of movement. Thus, the upper compression chamber 16 will immediately become open to the discharge port 13. The lower chamber 17, however, has a restriction 18 that will minimize the amount of fluid that can reach the discharge port 13 immediately. It would be desirable to have the chambers 16 and 17 communicate with the discharge port 13 in approximately equal amounts and time. Thus, the restriction 18 is undesirable. In addition, in the position shown in FIG. 1A, there is a small amount of fluid which is trapped between the wraps 11 and 12 at the end of the discharge cycle. That fluid becomes supercompressed, and can result in noise and forces tending to move the orbiting scroll 11 away from fixed scroll 12.

FIG. 1B shows an attempt to minimize the trapped fluid in the type of scroll compressor such as shown in FIG. 1A. As shown, the wrap 19 includes outer portion 14 and rear portion 15 centered on the radii R1 and R2. However, at an end point 21 of outer portion 14, a groove 22 is cut into the surface 15. This creates a chamber wherein the previously trapped fluid can be received such that the above-discussed problem does not occur. In this prior art scroll configuration, a line 23 extended from the surface 15 on the radius R2 would meet point 21. With this configuration, although the problem of trapped fluids may be reduced, the restriction 18 as illustrated in FIG. 1A still occurs. It is a goal of this invention to eliminate such restriction such that both compression chambers are quickly opened to the discharge port.

SUMMARY OF THE INVENTION

In a disclosed embodiment of this invention, the scroll tip geometry is improved such that compression chambers on either side of the orbiting scroll tip open to the discharge port in relatively equal amounts and time. The tip geometry could be described as the outer portion of the tip being centered on a first radius and the rear portion of the tip being centered on a second radius, with an interconnecting groove connecting the end of the outer and rear portions. However, contrary to the geometry as shown in FIG. 1B, the beginning of the groove at the end of the outer portion forms a thinner wrap portion than the end of the groove at the rear portion.

Stated another way, if the rear portion of the wrap, having the radius R2, were extended beyond the groove, it would not meet the end of the outer portion of the wrap, or the 21 point as shown in FIG. 1B. Instead, as will be explained in greater detail below, the extended line would be spaced closer to the opposed scroll wrap than the outer portion.

Each scroll wrap has a tip facing the opposed tip with an outer portion having a forward ledge that merges into a curve, with the curve extending outwardly to a ledge which merges into the rear portion. The opposed forward and rear ledges define the ending points of the compression cycle. That is, at the end of a compression cycle, the forward ledge of one scroll wrap contacts the rear ledge of an opposed scroll wrap. As the orbiting scroll begins to move beyond this end point, the shape of the groove ensures that chambers both above and below the inner portion are exposed to the discharge ports in approximately equal amounts and at the same time. The restriction to flow that has occurred in the prior art is thus eliminated.

The configuration of the tip of the scroll wrap could also be described by defining the swing radius beginning from the origin point of the scroll wrap. The swing radius begins on a first side of zero at a point defined between the rear ledge of the fixed scroll and the forward ledge of the orbiting scroll. The swing radius moves towards zero, and is soon equal to zero. The swing radius then moves to the opposed side of zero at all locations beyond the zero swing radius point. Movement of the swing radius from one side of zero, across zero, and to the other side of zero for the remainder of the wrap is unique for this invention. This swing radius behavior provides a scroll wrap tip which achieves the beneficial results described above.

These and other features of the present invention can be best understood from the following specification and drawings, of which the following is a brief description.

DETAILED DESCRIPTION OF A PREFERRED EMBODIMENT

Figure 2A:
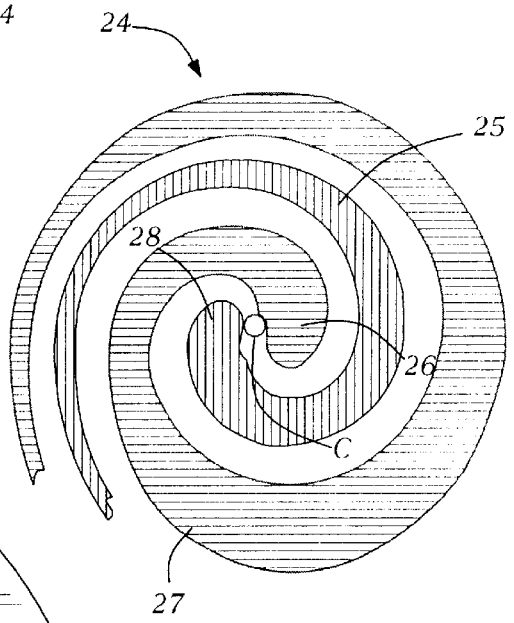
FIG. 2A shows the inventive total scroll wrap geometry in a position where both fixed and orbiting scroll are centered on the common center of the scroll members, i.e. the fixed and orbiting scrolls are separated from each other by a distance equivalent to half of the orbiting radius.

FIG. 2A shows the scroll compressor 24 incorporating a non-orbiting scroll wrap 27 and an orbiting scroll wrap 25. As known, the non-orbiting scroll may be fixed as shown. An inner portion 26 of the fixed scroll wrap and an inner portion 28 of the orbiting scroll wrap are spaced approximately equally about a center line C. Of course, during operation of this scroll, the orbiting scroll wrap is seldom in the position illustrated in FIG. 2A. However, for purposes of generating the scroll wrap, the orbiting scroll wrap is assumed to be in the position wherein its tip 28 is equally centered about the center C relative to the tip 26 of the fixed scroll 27.

Figure 2B:
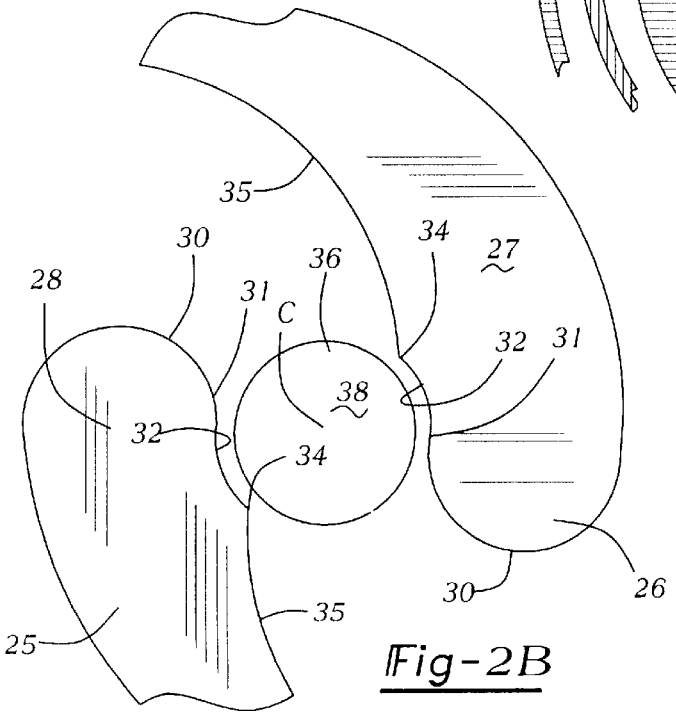
FIG. 2B shows the scroll wrap in a position where both are centered on the common center of the scroll members.

FIG. 2B shows a detail of the inner portion 26 and 28. The inner portion have generally the same configuration, and common reference numerals are utilized to describe the geometry of the inner portion.

As shown, a forward portion 30 of the inner portion extends to a forward ledge 31 which merges into a curve 32 leading to a rear ledge 34. A rear curve 35 then extends from ledge 34 into the remainder of the scroll wrap.

The curve 32 curves generally toward the opposed scroll wrap between the forward ledge 31 and the rear ledge 34 such that a forward wrap thickness measured at forward ledge 31 is generally thinner than the wrap at a location aligned with the rear ledge 34. In some applications the forward face of the wraps could have a configuration other than shown in this figure, and it is possible that the thickness would not meet the above relationship. However, as shown in FIG. 2B, the forward face of the wraps is generally on a common curve, and the wrap is thicker at ledge 34 than it is at ledge 31.

Figure 3A:
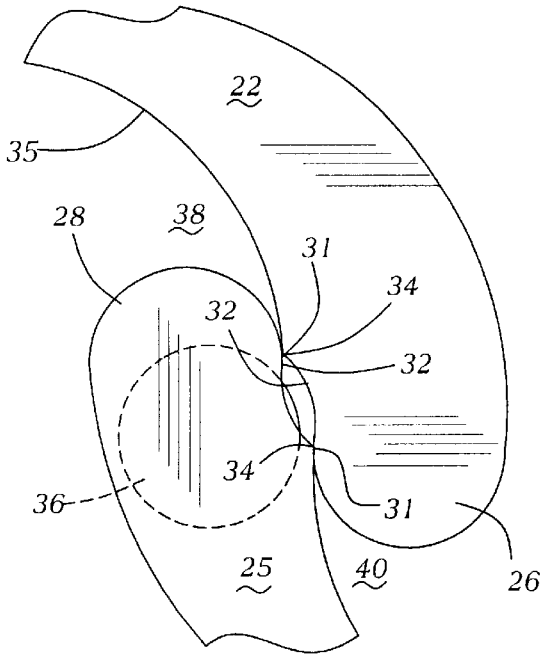
FIG. 3A shows the invention scroll wraps at the end of one discharge cycle.

As shown in FIG. 3A, the wraps 27 and 25 are now at the point where they have completed a discharge cycle. The orbiting scroll tip 28 generally covers discharge port 36. The forward ledge 31 of the orbiting scroll generally abuts the rear ledge 34 of the fixed scroll. Similarly, the forward ledge 31 of the fixed scroll abuts the rear ledge 34 of the orbiting scroll. A compression chamber 38 is defined generally above the tip 28 and a second compression chamber 40 is defined generally between the tip 26 and the opposed wrap 25.

Figure 3B:
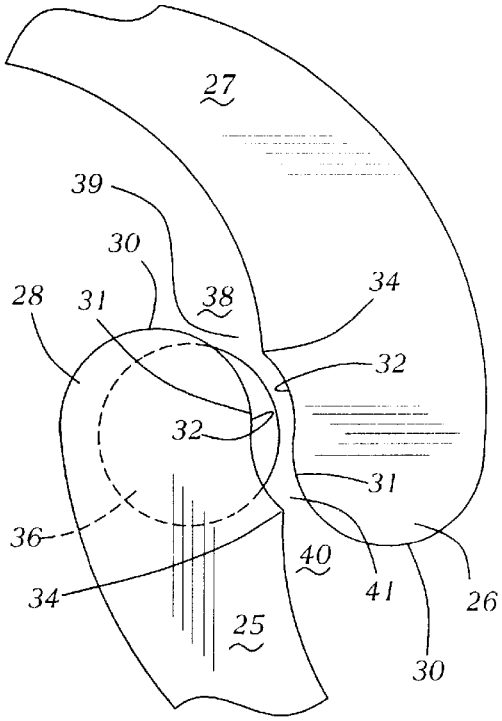
FIG. 3B shows a point slightly subsequent to the point shown in FIG. 3A.

As shown in FIG. 3B, the next increment of movement of the orbiting scroll essentially is downward as shown in this figure. Thus, an opening 39 begins to communicate the chamber 38 to the discharge port 36. The opening 39 is defined between the rear ledge 34 of the fixed scroll tip 26 and the forward portion 30 of the orbiting scroll. Similarly, the rear ledge 34 of the orbiting scroll is moving along the forward portion 30 of the fixed scroll and defining an opening 41 for the chamber 40 to communicate with the discharge port 36.

Figure 3C:
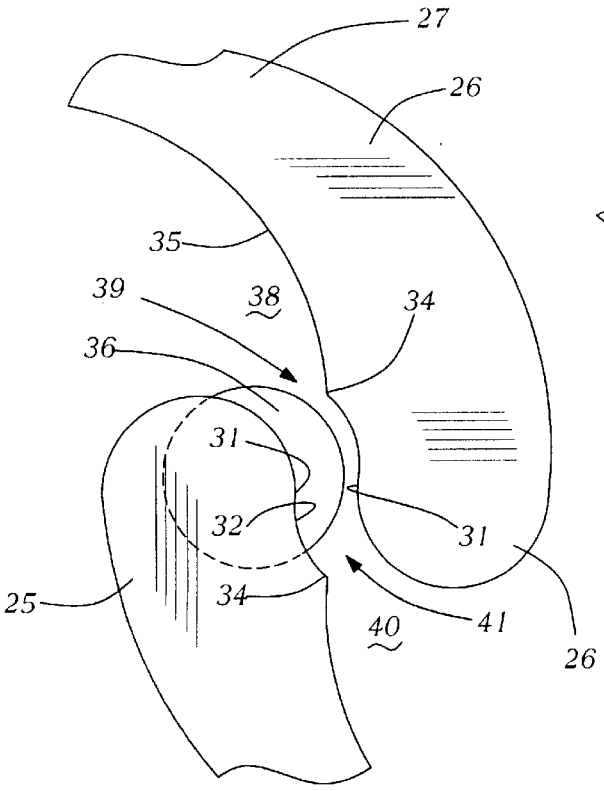
FIG. 3C shows a point slightly subsequent to the point shown in FIG. 3B.

As shown in FIG. 3C, the orbiting scroll has now moved another incremental amount. As can be seen, the openings 41 and 39 are generally equal, and do not unduly restrict the flow of fluid from the chambers 38 and 40 to the discharge port 36. This is an improvement over the prior art wraps wherein there was a tight restriction on the chamber 40.

Figure 4:
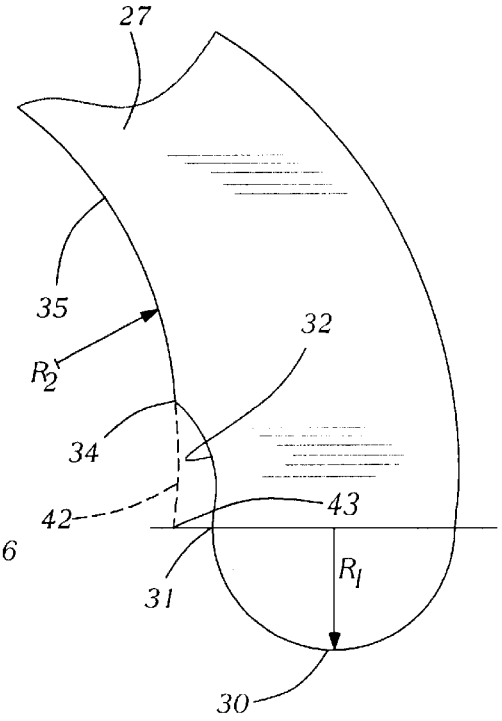
FIG. 4 shows a detail of one inventive inner portion of scroll wrap.

FIG. 4 shows a detail of the tip of one of the scroll wraps. As shown, the forward ledge 31 begins forward portion 30, which is centered on a radius R1. The curve 32 extends back to a rear ledge 34 and a rear curve 35 extends from the rear ledge 34 to a subsequent portion of the wrap. The curve 35 is centered on a radius R2. An extension 42 is included which extends curve 35, if the curve 35 were to continue to be defined at the radius R2 beyond the ledge 34. As shown, the extension 42 would end at a point 43 which is spaced from the actual ledge 31. This is another way of describing how the wrap is thinner at the forward ledge 31 than it is at the rear ledge 34.

For purposes of this application, the FIG. 4 geometry is described as if the curves 30 and 35 were exactly centered on a single radius. In some applications, the actual wraps may differ from actual circular portions. Even so, this invention extends to scroll wraps having a configuration such that the radius which best fits the scroll curve portions would have the features such as shown in FIG. 4.

Figure 5A:
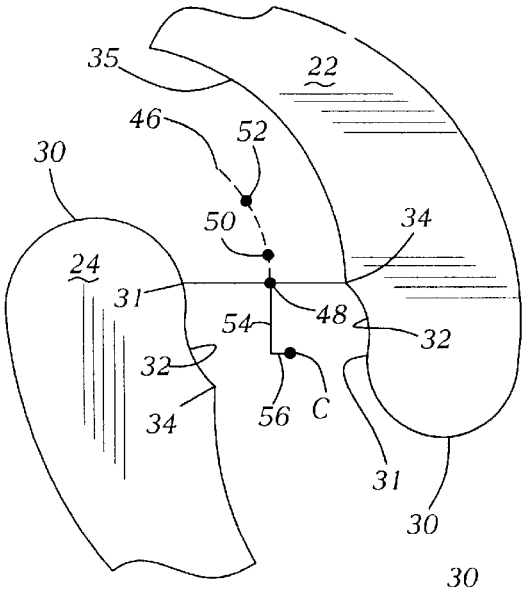
FIG. 5A shows the swing radius at a first point on the inventive scroll compressor, in a position where both fixed and orbiting scroll are centered on the common center of the scroll members.
Figure 5B:
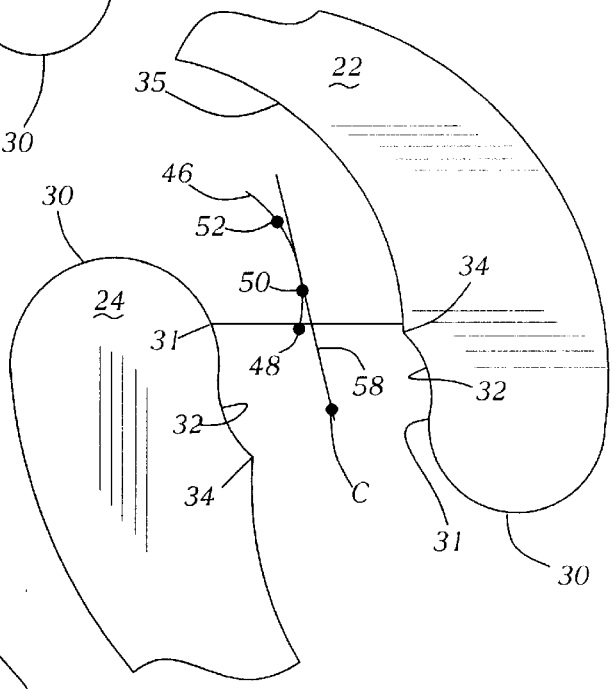
FIG. 5B shows a swing radius of a point spaced slightly from the point of FIG. 5A.
Figure 5C:
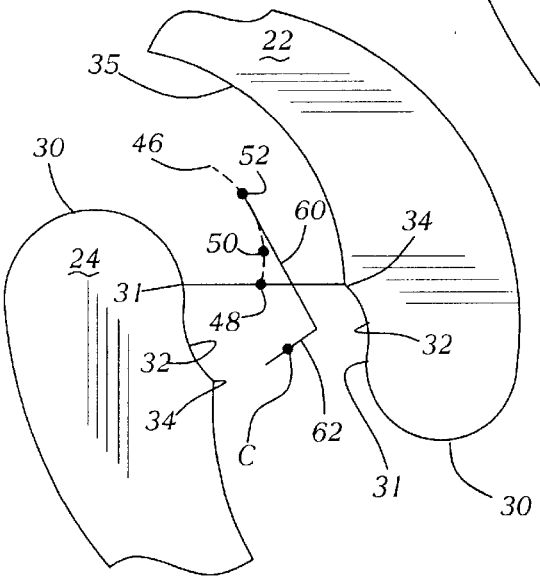
FIG. 5C shows a swing radius at a point spaced slightly from the point shown in FIG. 5B.

FIG. 5A through 5C shows another feature of the inventive scroll wrap. The center point C lies on a center path 46 between the fixed and orbiting scrolls. Path 46 is defined as the central path between the fixed and orbiting scroll wraps.

As known in the scroll art, a scroll wrap geometry is defined by the generating radius and swing radius at the points along the center path 46. As shown in FIG. 5A, a first point 48 is defined at the location between forward ledge 31 of one wrap and the rear ledge 34 of the opposed wrap. A vector defined between the center C and the point 48 includes a generating radius portion 54 and a swing radius portion 56. The generating radius portion 54 is defined tangent to the path 46 at the point 48. The swing radius portion is the vector that needs to be combined with the generating radius to achieve the actual vector extending between the center C and the point 48. The swing radius 56 is defined as a negative swing radius and is on a first side of the generating radius 54. Of course, negative and positive are somewhat relative. However, as will be explained with regard to FIGS. 5B and 5C, in the inventive geometry the swing radius crosses zero and moves to the other side of the center C in this invention.

Figure 1A:
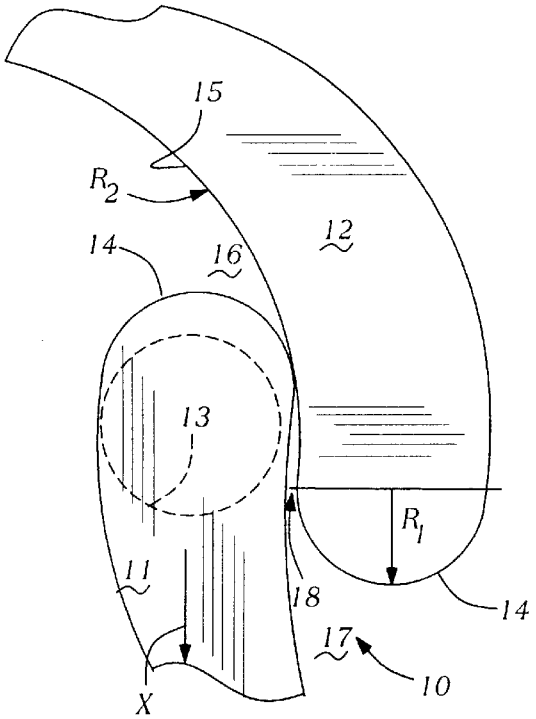
Fig-1A PRIOR ART
FIG. 1A shows a first prior art scroll wrap geometry.
Figure 1B:
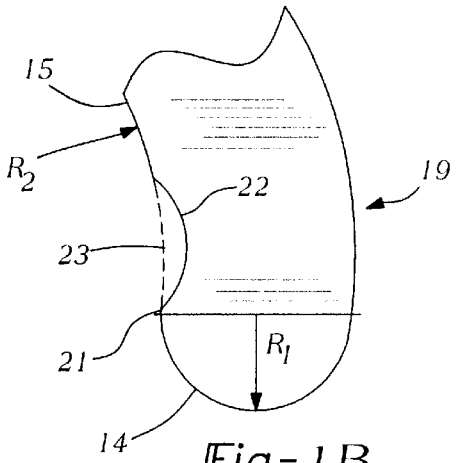
Fig-1B PRIOR ART
FIG. 1B shows a second prior art scroll wrap geometry.

As shown in FIG. 5B, a subsequent point 50 has a vector 58 that is equal to the generating radius. That is, at the point 50, a line drawn tangent to the curve 46 would be the vector 58 from the center C to the point 50. In the prior art such as shown in FIG. 1A, the initial point has a generating radius which is equal to the vector between the center and the point. When the generating radius is equal to this vector, then the swing radius is zero.

As shown in FIG. 5C, at another point 52 subsequent to the point 50, the vector includes a generating radius portion 60 and a swing radius 62 which is now on an opposed side of the generating radius 60 from the side shown in FIG. 5A. This geometric description results from wraps having the inventive benefits as described above.

Figure 6:
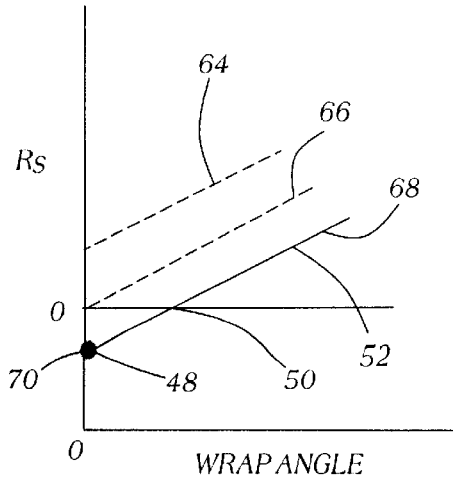
FIG. 6 graphically shows the swing radius for the three points as illustrated in FIGS. 5A–5C.

As shown in FIG. 6, the points 48, 50 and 52 are plotted on a plot of swing radius versus wrap angle. Line 64 shows the standard scroll compressor that does not have the arc of circle configuration as shown in FIG. 1A. The entirety of the wrap angles have a positive swing radius.

Line 66 shows the type of scroll wrap as shown in FIG. 1A. The initial point has a swing radius of zero and increases with increasing wrap angle.

The line 68 shows the inventive scroll wrap. The initial point 70 is below zero at point 48. The swing radius then moves towards zero and crosses zero at point 50. Thus, by the time the scroll wrap reaches point 52, it has achieved a positive swing radius, and the swing radius will continue to be positive for the remainder of the wrap.

A preferred embodiment of this invention has been disclosed, however, a worker of ordinary skill in the art would recognize that certain modifications would come within the scope of this invention. For that reason, the following claims should be studied to determine the true scope and content of this invention.

What is claimed is:

1. A scroll compressor comprising:

a non-orbiting scroll having a base and a spiral scroll wrap extending from said base, said wrap having a tip adjacent a center of said non-orbiting scroll wrap;

an orbiting scroll having a base and a generally spiral scroll wrap extending from said base, said orbiting scroll having a tip adjacent a center of said orbiting scroll, said orbiting and non-orbiting scroll wraps intermitting to define compression chambers; and said tip of both of said non-orbiting and orbiting scroll wrap having an inner surface facing the opposed wrap, configured to have a forward ledge adjacent said tip and a rear ledge spaced from said forward ledge in a direction away from a forwardmost end of said tip, said forward ledge defining a thinner portion of said wrap and said rear ledge defining a thicker portion of said wrap, said rear ledge of one of said wraps being in contact with said forward ledge of the other of said wraps at the end of a compression cycle, and said configuration of said tip allowing compression chambers defined on both sides of said non-orbiting and orbiting scroll wraps to open approximately equally, after said end of said compression cycle.

2. A scroll compressor as recited in claim 1, wherein a portion of said scroll wrap which is initially on one side of zero is defined at a location between a forward ledge of one wrap and a rear ledge of an opposed wrap.

3. A scroll compressor as recited in claim 1, wherein said forwardmost end of said tip is of a forward curve generally centered on a first radius and extending to said forward ledge, a portion of said at least one scroll wrap beyond said rear ledge is a rear curve generally centered on a second radius, and a central curve extending from said rear edge to said forward ledge, said rear curve being configured such that if said rear curve were continued beyond said rear ledge at said second radius, an extension of said rear curve is spaced from said forward ledge toward said wrap of the opposed scroll.

4. A scroll compressor as recited in claim 3, wherein said scroll wraps have forward surfaces which are shaped on a curve.

5. A scroll compressor as recited in claim 3, wherein a swing radius for said tip of said at least one scroll wrap is initially on one side of zero, moves to a position where it is equal to zero, and then crosses zero and moves to the other side of zero.

6. A scroll compressor comprising:

a non-orbiting scroll having a base and a spiral scroll wrap extending from said base, said wrap having a tip adjacent a center of said non-orbiting scroll wrap;

an orbiting scroll having a base and a generally spiral scroll wrap extending from said base, said wrap having a tip adjacent a center of said orbiting scroll, said orbiting and non-orbiting scroll wraps interfitting to define compression chambers;

said tip of both of said non-orbiting and orbiting scroll wrap having a forward portion and a circular curve which best corresponds to said forward portion being centered on a first radius to extend to a forward ledge, a center curve extending away in a direction from said tip, and from said forward ledge to a rear ledge and a circular curve which best corresponds to said forward portion being centered on a second radius, said rear curve being configured such that if said rear curve were continued beyond said rear ledge at said second radius, an extension of said rear curve is spaced toward said opposed scroll wrap from said forward ledge, said rear ledge of one of said wraps being in contact with said forward ledge of the other of said wraps at the end of a compression cycle, said configuration of said tip allowing compression chambers defined on both sides of said non-orbiting and orbiting scroll wraps to open approximately equally, after said end of said compression cycle.

7. A scroll compressor as recited in claim 6, wherein said scroll wraps have forward surfaces which are shaped on a curve.

8. A scroll compressor as recited in claim 6, wherein a swing radius for said tip of said at least one scroll wrap is initially on one side of zero, moves to a position where it is equal to zero, and then crosses zero and moves to the other side of zero.

9. A scroll compressor as recited in claim 8, wherein a portion of said scroll wrap which is initially on one side of zero is defined at a location between a forward ledge of one wrap and a rear ledge of an opposed wrap.

10. A scroll compressor comprising:

a non-orbiting scroll having a base and a spiral scroll wrap extending from said base, said wrap having a tip adjacent a center of said non-orbiting scroll wrap;

an orbiting scroll having a base and a generally spiral scroll wrap extending from said base, said orbiting scroll having a tip adjacent a center of said orbiting scroll, said orbiting and non-orbiting scroll wraps interfitting to define compression chambers;

said non-orbiting and orbiting scroll wraps being configured such that a swing radius at an initial point is on one side of zero, moves to a position where it is equal to zero, and then crosses and moves to the other side of zero.

11. A scroll compressor as recited in claim 10, wherein said scroll wraps have forward surfaces which are shaped on a curve.

12. A scroll compressor as recited in claim 10, wherein both said non-orbiting and orbiting scroll have an inner surface with said configuration.

13. A scroll compressor as recited in claim 10, wherein said configuration of said tip allows compression chambers on both sides of said non-orbiting and orbiting scroll inner portion to open approximately equally.

14. A scroll compressor as recited in claim 10, wherein said initial point is defined at a point of contact between said non-orbiting and orbiting scroll wraps at a cyclic position at the end of the discharge cycle.

15. A scroll compressor as recited in claim 14, wherein said inner surfaces of said orbiting and non-orbiting scroll wraps have a forward portion extending to a forward ledge, and a rear ledge spaced away from said forward portion from said forward ledge, a central curve extending between said forward and rear ledges, and said forward ledge of one of said inner portion contacting said rear ledge of the other side inner portion contacting said rear ledge of the other of said inner portion at said end of the discharge cycle, said initial point being defined between said forward ledge of one of said orbiting and non-orbiting scrolls and said rear ledge of the other of said orbiting and non-orbiting scrolls.

16. A scroll compressor comprising:

a first scroll having a base and a generally spiral scroll wrap extending from said base, said first scroll wrap having a first wall surface and a first center;

a second scroll having a base and a generally spiral scroll wrap extending from said base, said second scroll wrap having a second wall surface and a second center, said first and second wall surfaces interfitting to define compression chambers therebetween;

an orbiting radius associated with said first and second scrolls;

a center line defined equally spaced between said first and second wall surfaces by a generally fixed distance equal to one half said orbiting radius when said first and second scroll wraps are positioned so that said first and second centers are coincident;

any given point on said centerline being associated with two mating points on said first and second wall surfaces through a line segment perpendicular to said centerline at said given point;

a pair of variable vectors serving to define any given point on said center line relative to said coincident first and second center points, said vectors comprising a generating radius vector which is disposed tangent to said given point on said center line and a swing radius vector which is disposed perpendicular to said given point on said center line;

said first and second wall surfaces configured such that a first point on said center line disposed at a centermost end of said center line and which represents the first pair of mating points on said first and second scrolls is characterized by nonzero values of both said generating radius and said swing radius vectors, said swing radius vector being disposed to one side of said generating radius vector;

said first and second wall surfaces also configured such that a second point on said center line is disposed outwardly of said first point and characterized by a nonzero value of said generating radius vector and a zero value of said swing radius vector; and said first and second wall surfaces additionally configured such that a third point on said center line is disposed outwardly of said first and second points and characterized by nonzero values of both said generating radius vector and said swing radius vector, said swing radius vector being disposed on the opposite side of said generating radius vector relative to said one side as defined by said first point.

* * * * *